United States Patent [19]

Orui et al.

[11] 3,963,952

[45] June 15, 1976

[54] HEAT-DISSIPATING DEVICE FOR THE COLLECTOR OF TRAVELING-WAVE TUBE

[75] Inventors: Ryuzo Orui; Genichi Goto; Toshio Yamaguchi, all of Tokyo, Japan

[73] Assignee: Nippon Electric Company Ltd., Tokyo, Japan

[22] Filed: May 19, 1975

[21] Appl. No.: 578,942

[30] Foreign Application Priority Data

May 29, 1974 Japan ..... 49-60756[U]

[52] U.S. Cl. ..... 313/45; 313/46

[51] Int. Cl.[2] ..... H01J 7/24

[58] Field of Search ..... 313/45, 46, 11

[56] References Cited

UNITED STATES PATENTS 3,644,769 2/1972 Kennedy ..... 313/46

*Primary Examiner*—R. V. Rolinec
*Assistant Examiner*—Darwin R. Hostetter
*Attorney, Agent, or Firm*—Hopgood, Calimafde, Kalil, Blaustein & Lieberman

[57] ABSTRACT

A solid heat-dissipating member having an axial aperture to slidably receive a collector of a traveling-wave tube, includes at least one radial hole opening to the axial aperture. A contacting element having a spherical surface is accommodated in the radial hole so as to be held in pressure contact with the collector under the action of a biasing spring arranged in the radial hole. The collector can be held in good thermal-conducting relation with the heat-dissipating member without the danger of seizing and can be smoothly withdrawn therefrom when required.

4 Claims, 2 Drawing Figures

HEAT-DISSIPATING DEVICE FOR THE COLLECTOR OF TRAVELING-WAVE TUBE

BACKGROUND OF THE INVENTION

This invention relates to an improved heat-dissipating or cooling device for the collector of a traveling-wave tube.

For the purpose of heat dissipation, it is conventional to provide, in a traveling-wave tube, a solid heat-dissipating member associated with the magnetic field device. This heat-dissipating member is apertured for fitting engagement with the collector of the traveling-wave tube. In this arrangement, the collector and the heat-dissipating member are preferably held in close contact at all times to achieve the optimum heat-dissipating effect. In addition, and particularly in a traveling-wave tube of the type in which the tube unit is detachably secured to the magnetic field device fitted with a solid heat-dissipating member, the collector must be readily removable from the heat-dissipating member without impairing the efficiency of heat conduction from the collector to the heat-dissipating member and without the danger of causing troubles such as seizing.

Various proposal have been made to meet these requirements. For example, in one known structure, the heat-dissipating member and the collector are formed to interfit with an appropriate taper. The collector and the heat-dissipating member are threadably joined together by manual control with the aid of a nut formed as a part of the heat-dissipating member. Another known form of a cooling device for a traveling-wave tube collector includes, as disclosed in U.S. Pat. No. 3,586,100, cylindrical collector with no taper and having a slidable fit in a correspondingly apertured heat-dissipating member. In operation, the interfitting collector and heat-dissipating member come into pressure engagement with each other as the temperature rises, thereby to establish an appropriate heat-conducting relation therebetween.

These prior devices, however, suffer from certain drawbacks that are inherent in their design. In the former device, in which a tapered collector is inserted into the heat-dissipating member and firmly secured thereto by turning a nut provided thereon, the collector must be removed to turn the nut reversely with a considerable effort. The second form of cooling device described is subject to physical limitation and high cost, particularly in those cases in which the device is of the natural air-cooling system requiring the formation of large cooling fins on the solid heat-dissipating member.

SUMMARY OF THE INVENTION

It is an object of the present invention to provide an improved heat-dissipating device for the collector of a traveling-wave tube in which the collector is properly secured to the solid heat-dissipating member appertaining to the magnetic field device for the traveling-wave tube without the need for manually fastening the collector, and which is comparatively small in size and economical.

According to the present invention, a heat-dissipating device for the collector of a traveling-wave tube is provided which includes a solid heat-dissipating member which has an axial aperture for slidably receiving the collector. The heat-dissipating device comprises at least one radial hole formed in the wall of the axial aperture and opening thereto. A contacting element is accommodated in the radial hole. The contacting element, in the embodiment herein described, has a spherical surface for making point contact with the collector received in the axial aperture. A biasing spring is arranged in the radial hole radially outwardly of the contacting element and is fixed at one end to act at the other end to urge the contacting element into pressure contact with the collector.

The above and other objects, features and advantages of the present invention will become apparent from the following description taken in conjunction with the accompanying drawing, in which:

DESCRIPTION OF THE PREFERRED EMBODIMENT

Figure 1:
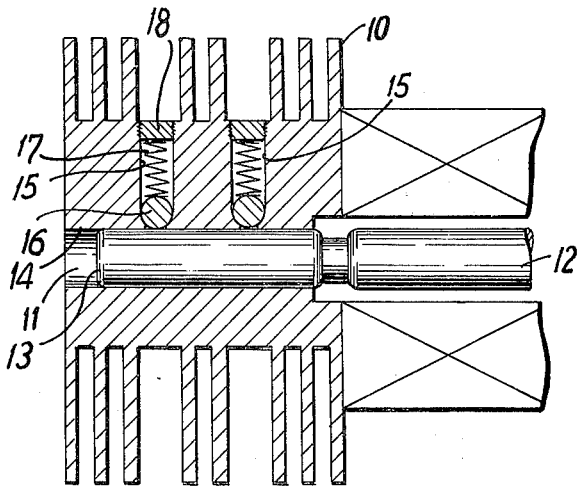
FIG. 1 is a cross-sectional view of a heat-dissipating device embodying the present invention, showing a collector loosely fitted therein.

Referring first to FIG. 1, there is shown a solid heat-dissipating or cooling member of heat-conducting material, generally designated 10. The heat-dissipating member is formed with an axial aperture 11 in which a collector 13 of a traveling wave tube 12 is slidably fitted. In a conventional arrangement, it is difficult to hold the collector in close contacting engagement with a wall, indicated as 14, of the axial aperture by mere insertion therein, such that, in operation, the collector tends to be excessively heated as a result of the limited heat conduction to the heat-dissipating member 10 in which it is fitted.

To overcome this situation, the heat-dissipating device according to the invention includes a pair of radial holes 15 formed in the wall 14 of the axial aperture 11 perpendicular to the common axis of the traveling-wave tube 12 and the axial aperture 11. As shown in FIG. 1, these holes extend parallel to each other and open into the axial aperture 11 at one end thereof. Accommodated in each of the radial holes 15 is a contacting element having a spherical surface, which in the embodiment shown, is in the form of a bearing ball 16 made of steel. A coiled spring 17 is arranged under compression in the radial hole 15 to bias the contacting element or bearing ball 16 radially inwardly and is seated at one end against a plug 18, which is threadably fitted in the radial hole 15 at its radially outer end. As shown, the coiled spring 17 is seated at its other, radially inner end against the bearing ball 16 to hold the latter in pressure contact with the collector 13.

Figure 2:
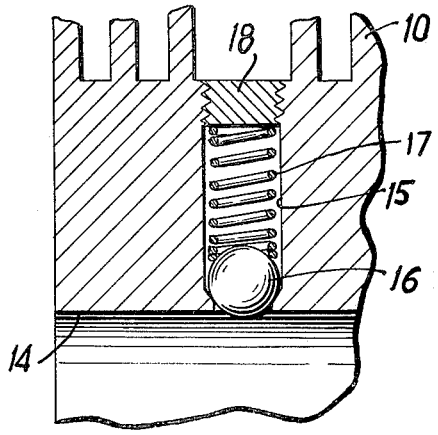
FIG. 2 shows an enlarged fragmentary cross section of the heat-dissipating device of FIG. 1 with the collector removed.

With this arrangement, before the collctor 13 is inserted in the heat-dissipating member 10, the bearing balls 16 under the biasing force exerted by coiled springs 17 extend radially inwardly, for example, from 0.3 to 0.5 millimeter, beyond the wall surface 14 of the axial aperture 11, as shown in FIG. 2. However, when the collector 13 is inserted in the aperture 11 to fit slidably with some clearance, the bearing balls 16 are thrust radially outwardly by the collector 13 against the bias force of coiled springs 17, and the collector is thus placed in pressure contact with the wall surface 14 of axial aperture 11 on its side remote from the bearing balls 16 under the biasing force of coiled springs 17.

As shown, the radial holes 15 are each formed at their radially inner ends with an annular ball seat (not indicated) to hold the bearing ball 16 in its position extended into the axial aperture 11. It will be readily appreciated that the pressure engagement of the collector 13 with the bearing balls 16 allows the traveling-wave tube with the collector to be inserted into or withdrawn out of the heat-dissipating member 10 easily and smoothly without being subjected to any substantially resistance.

Experiments with the above-described embodiment, which included a heat-dissipating member made of brass and a collector made of copper, revealed that a power consumption of 83 watts at the collector resulted in a temperature difference between the cooling member and the collector of only 14°C. Under this condition, a good working state can be maintained with no seizing occurring between the collector and the heat-dissipating member even in continuous operation of the traveling-wave tube.

It has experimentally been proven, therefore, that the simplified heat-dissipating structure of the present invention achieves a cooling efficiency that is comparable to or even better than that of the conventional structure, in which the temperature difference between the collector and the cooling member exceeds 25°C with a power consumption of 90 watts at the collector (as in the device disclosed in said U.S. Pat. No. 3,586,100).

From the foregoing description, it will be seen that a novel and improved heat-dissipating device for a traveling-wave tube has been provided which readily achieves the objects of the invention. Although only one preferred embodiment of the invention has been specifically shown and described herein, it will be apparent to those skilled in the art that changes may be made as regards the details thereof, such as in the number of radial holes formed in the cooling member, without necessarily departing from the spirit of the invention.

What is claimed is:

1. A heat-dissipating device for the collector of a traveling-wave tube of the type in which the collector is loosely fitted in an axial aperture formed in a solid heat-dissipating member, said heat-dissipating device comprising at least one radial hole formed in the wall of said axial aperture and opening thereto, a contacting element accommodated in said radial hole and having a spherical surface for contacting engagement with the collector fitted in said axial aperture, and biasing means arranged in said radial hole radially outwardly of said contacting element and fixed at one end to act at the other end to urge said contacting element into pressure contact with said collector.

2. The heat-dissipating device of claim 1, comprising first and second radial holes parallel to one another and spaced from one another along the axis of the collector.

3. The heat-dissipating device of claim 2, in which said contacting element is in the form of a ball attached to the radially inward end of said biasing means.

4. The heat-dissipating device of claim 3, further comprising a plug inserted at the radially outward end of said axial aperture and contacting the radially outward end of said biasing means.

* * * * *

UNITED STATES PATENT OFFICE

CERTIFICATE OF CORRECTION

Patent No. 3,963,952 Dated June 15, 1976

Inventor(s) R. Orui et al

It is certified that error appears in the above-identified patent and that said Letters Patent are hereby corrected as shown below:

In the caption, please change Assignee: "Nippon Electric Company Ltd.," to -- Nippon Electric Company, Limited --.

Signed and Sealed this

Nineteenth Day of October 1976

[SEAL]

*Attest:*

RUTH C. MASON
*Attesting Officer*

C. MARSHALL DANN
*Commissioner of Patents and Trademarks*